US006672425B1

(12) United States Patent
Simmons

(10) Patent No.: US 6,672,425 B1
(45) Date of Patent: Jan. 6, 2004

(54) NOISE ABATEMENT MODULE

(75) Inventor: Clint B. Simmons, Sedro Woolley, WA (US)

(73) Assignee: Onyx Industrial Services, Inc., Baytown, TX (US)

( * ) Notice: Subject to any disclaimer, the term of this patent is extended or adjusted under 35 U.S.C. 154(b) by 0 days.

(21) Appl. No.: 10/205,295

(22) Filed: Jul. 24, 2002

(51) Int. Cl.[7] ..... F01N 1/10

(52) U.S. Cl. ..... 181/252; 181/264; 181/265; 181/278; 181/281; 181/267

(58) Field of Search ..... 181/252, 264, 181/265, 278, 281, 259, 267

(56) References Cited

U.S. PATENT DOCUMENTS

| | | | | | |
|---|---|---|---|---|---|
| 1,818,469 | A | | 8/1931 | Floyd | 181/254 |
| 2,403,403 | A | | 7/1946 | Sauer | 181/274 |
| 3,374,857 | A | | 3/1968 | Hutchins | 181/244 |
| 4,109,753 | A | | 8/1978 | Lyman | 181/252 |
| 4,325,459 | A | * | 4/1982 | Martin | 181/248 |
| 4,966,253 | A | * | 10/1990 | Stephens et al. | 181/227 |
| 5,058,381 | A | | 10/1991 | Christenson et al. | 60/299 |
| 5,058,704 | A | * | 10/1991 | Yu | 181/262 |
| 5,962,822 | A | | 10/1999 | May | 181/264 |

* cited by examiner

*Primary Examiner*—Shih-Yung Hsieh
(74) *Attorney, Agent, or Firm*—Bracewell & Patterson LLP

(57) ABSTRACT

The current invention is device for lowering the air velocity and inherent noise of high-speed air released from a closed system, comprising a straight pipe module with an outer tube and a concentric inner tube creating an annular space therebetween. The inner tube has interior fins at the inlet, which initiate rotation in an airflow directed therethrough, and interior fins at the outlet, which arrest the airflow rotation. Perforations along the length of the inner tube, from inlet fins to outlet fins, permit the release of a turbulent outer zone of the airflow, permitting the high velocity core of the airflow to expand and slow, reducing the noise of the airflow.

13 Claims, 2 Drawing Sheets

NOISE ABATEMENT MODULE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This invention relates to a noise abatement system for lowering air velocity in a closed system. Specifically, the invention describes a straight pipe module suppressor, with internal vanes, which reduces the velocity of air used in an industrial airblow cleaning operation.

2. Description of the Related Art

High pressure/high velocity air may be used to clean industrial piping. Reference to cleaning in this application is the process of removing loose and/or lightly adhered debris from piping. The piping to be cleaned may be that which is used in the operation of a power generating plant by providing steam to turbines, in a petrochemical plant to provide stock or product to a process or storage unit, or in any other environment using piping that is typically operated under high pressure and/or high temperature.

The piping to be cleaned may be new fabrication, which may nonetheless contain dirt, sand, loose bolts, used welding rods or other non-structural items or debris left from the fabrication process. Alternatively, the piping to be cleaned may already have been in service and in need of cleaning to remove built-up material (usually scaling) on the interior of the piping. Typically, cleaning of piping that has been in service is accomplished by first flushing the line with a chemical flush to loosen the mill scale, which is solubilized into a solution. The line is then rinsed, and the metal neutralized (washed) to remove the solution containing the chemical flush and the soluble scale particles. The remaining loose or lightly adhered insolubles left in the piping are then removed with the high-pressure air.

Debris from either new fabrication or scaling can damage downstream equipment, such as a turbine, processing unit or other equipment/systems. For example, high pressure impingement of debris on turbine blades operating at high speed could result in damage or catastrophic failure of the turbine.

In a typical pipe cleaning operation, the piping to be cleaned is connected at its upstream end to an air pressurization system, typically a pressure vessel and/or piping, and at its downstream end to a temporary bypass line. The temporary bypass line diverts the high pressure cleaning air away from downstream equipment.

In either use of high pressure air for cleaning piping (new or used), the air pressurization system is typically charged to a level sufficient to provide air pressure through the piping 1.2 times the normal operating pressure of the piping. This high pressure air passes through the piping and is discharged along with the debris out of the piping.

If the high pressure cleaning air, typically traveling at or above sonic speed through the piping, is released directly to the environment without velocity suppression, the noise is intolerable. It is not unusual for such a release to generate noise levels between 115 dB and 140 dB, which can cause hearing loss to those nearby and structural damage or nuisance several miles away. Further, high pressure air can penetrate the skin of a person exposed to the exhaust airflow. This air penetration through the skin can cause air embolisms in the blood vessels, which can be fatal. Thus an air velocity suppression/reduction system is needed in such environments.

Air velocity suppressors for high pressure/high velocity air used to clean piping air are found in the prior art. However, these silencers typically use a baffle system to reduce the velocity of the air. These create unwanted back-pressure that reduces the velocity of the air upstream in the cleaning process, thus creating the requirement for higher initial air velocity.

Other air velocity/noise suppressors use a muffling device with a closed cap end, and direct all airflow laterally outward through release holes in the sides of the inner and outer pipes of the suppressor. This system is dangerous when used with high velocity/high pressure stream, since sudden blockage of the release holes, as from a large piece of debris, will cause immediate over-pressurization of the suppressor and likely explosion.

Air suppressor systems used in low velocity applications, such as mufflers used on internal combustion machines or small scale pneumatic silencers on leaf blowers and the like, are unacceptable in high pressure/high velocity air cleaning systems. These low velocity devices, even if scaled up, are unable to adequately reduce the volume and velocity of high-pressure air being exhausted from the system due to their structural and design limitations.

BRIEF SUMMARY OF THE INVENTION

Accordingly, the objectives of this invention are to provide, inter alia, a new and improved air suppression system that:

Does not create undue back pressure;

Does not pose a risk of sudden blockage;

Reduces high air velocity, including those about sonic speed;

Uses standard fabrication components; and

Is cost effective.

These objectives are addressed by the structure and use of the inventive device. A straight through pipe has air directing internal vanes attached to the interior wall of an inside tube. The walls of the inside tube are perforated to permit airflow separated from the main air stream to escape to a space between the inside tube and the outside tube. These vanes cause the high velocity air to rotate about its directional axis. Laminar resistance of the rotation causes a tail of air to form, moving away from the center or core of the exhaust stream and against the interior wall of the inside tube. The high velocity air being released into the inside tube has an exhaust 15 shape shown in FIGS. 6 and 6A, comprising a outer layer 19 and a core 17. Outer layer 19 is formed as laminar resistance allows side air to move away from the center of exhaust 15, while the faster air of core 17 speeds through the center of the inner tube 30. By directing exhaust 15 to rotate about its linear axis, outer layer 19 is "chewed away" as its air is directed into velocity dampening areas between the inside tube 30 and the outside tube 20 of the invention. As outer layer 19 is removed, it is replaced by air from core 16, thus decreasing the overall velocity of exhaust 15.

Other objects of the invention will become apparent from time to time throughout the specification hereinafter disclosed.

DETAILED DESCRIPTION OF THE INVENTION

Figure 1:
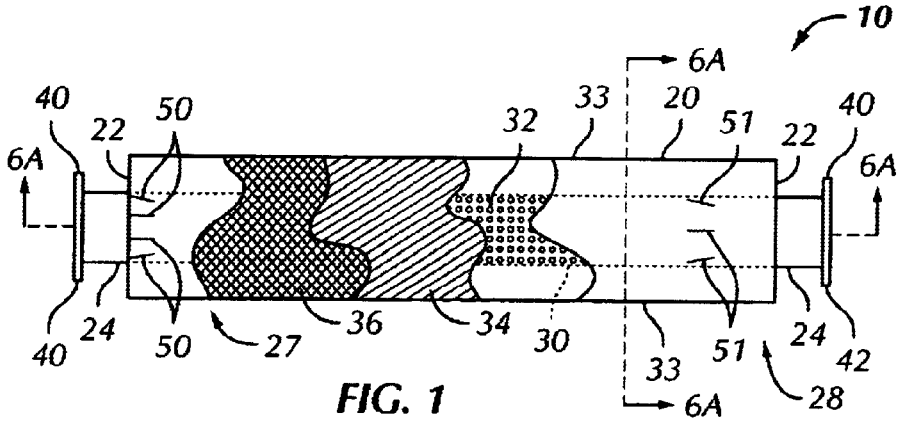
FIG. 1 depicts a single inventive noise abatement module.
Figure 2:
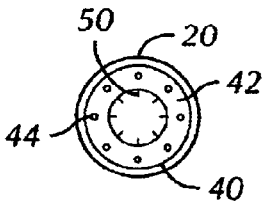
FIG. 2 depicts an inlet view of the single noise abatement module of FIG. 1.
Figure 3:
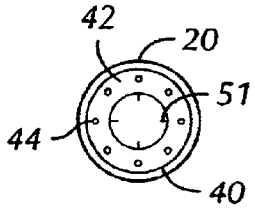
FIG. 3 depicts an outlet view of the single noise abatement module of FIG. 1.

The present invention comprises the module shown as noise abatement module 10, depicted in FIGS. 1, 2 and 3. Noise abatement module 10 comprises an inside tube 30 that is connected at each end to stubs 24, which are attached to flanges 40. Each flange 40 has a flange face 42 and typically flange bolt holes 44 for mating with and bolting to piping and/or other noise abatement modules 10. Circumferential about inside tube 30 is outside tube 20, defining annular inside space 33. Outside tube 20 has outside tube ends 22 that define the inlet and outlet boundaries of inside space 33 between inside tube 30 and outside tube 20.

An insulating material 34 may be position in space 33 between inside tube 30 and outside tube 20. When used in noise abatement module 10, insulating material 34 may be supported in place by expanded material 36. Expanded material 36 is rigid enough to hold insulating material 34 in place in space 33, yet is flexible to be shaped around insulating material 34 and inside tube 30, as well as permeable to air. In the exemplary embodiment, the insulating material is a blanket of insulation, typically fiberglass or kaowool. Also in the exemplary embodiment as expanded material 36 is a sheet of wire mesh 34, wrapped around the insulation blanket 34 to hold the insulating material 34 in place between the inner wall of outside tube 20 and the outer wall of inside tube 30.

The diameters of inside tube 30 and outside tube 20 are any that can accommodate the high velocity airflow to be suppressed. In typical applications of noise abatement module 10 being used to abate noise from industrial pipe and vessel air cleaning, inside tube 30 typically has an inner diameter of 30" to 38" (76.2 cm to 96.5 cm), and outside tube 20 typically has an inner diameter of 40" to 54" (101.6 cm to 147.2 cm).

Inside tube 30 has inside tube perforations 32, which are typically ⅛" to ⅜" (3.2 mm to 15.9 mm) in diameter. In the exemplary embodiment, inside tube perforations 32 are intermediate inlet vanes 50 and outlet vanes 51.

Figure 4:
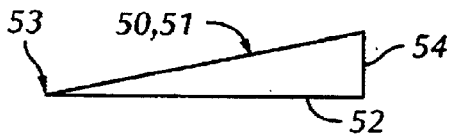
FIG. 4 depicts a side view of either a single inlet vane or outlet vane.
Figure 5:
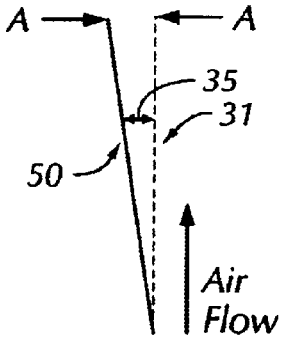
FIG. 5 depicts a top view of an inlet vane showing its oblique offset from the axial centerline of the direction of inlet airflow.

Inlet vanes 50 are attached to the interior wall of inside tube 30 at the air inlet side 27. In the exemplary embodiment inlet vanes 50 are six in number and circumferentially equally spaced, as shown in FIG. 2. As shown in FIG. 4, each inlet vane 50 has a vane base 52 and a vane first end 53 and a vane second end 54. Vane second end 54 is a trailing end as viewed by the airflow past inlet vane 50. Airflow travels first past first vane end 53, past the length of inlet vane 50, and then past vane second end 54. Vane base 52 is attached to the interior wall of inside tube 30, typically with a weld. In an exemplary embodiment where inside tube 30 has a 36" (91.4 cm) inner diameter, vane base 52 is 8"–16" (20.3 cm to 40.6 cm), vane first end 54 is 1"–3" (2.5 cm to 7.6 cm) high, and vane second end 53 is less than ½" (12.7 mm). As shown in FIG. 5, an inside tube centerline 31 is referenced at each inlet vane 50, which passes through vane first end 53 and runs parallel with the length of inner tube 30 along the inner wall. Each inlet vane 50 is oriented oblique to an inside tube centerline 31. In the exemplary embodiment an offset angle 35 is 0.5° to 2.0°. Such an angle results in inlet vane offset A being approximately 0.25" (6.3 mm) where vane base 52 is 12" (30.5 cm). Each inlet vane 50 is thus offset obliquely to its own inside tube centerline 31 while remaining normal to the interior wall of inside tube 30, as depicted in FIG. 2. While inlet vane 50 is shown in FIG. 5 as a straight vane, alternatively inlet vane 50 can have an arcuate shape (not shown) that results in the same amount of inlet vane offset A as described above for a straight vane.

Figure 5A:
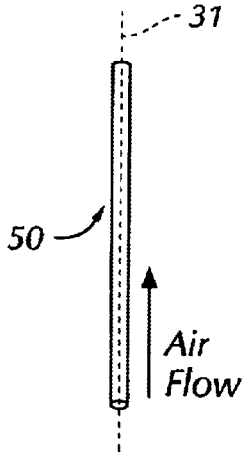
FIG. 5A depicts a top view of an inlet vane with no offset.
Figure 6:
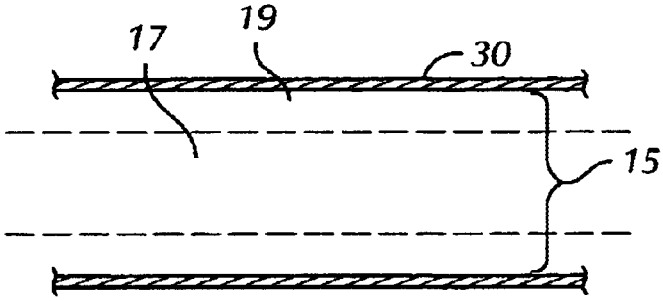
FIG. 6 a view of the regions of high velocity air as it travels through the inner tube of FIG. 1, cut at line 6—6.
Figure 6A:
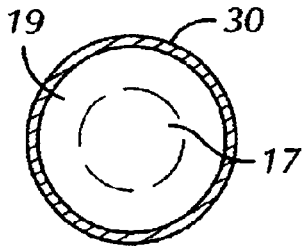
FIG. 6A is a view of the regions of high velocity air as it travels through the inner tube of FIG. 1, cut at line 6A—6A.

Outlet vanes 51 are attached to the interior wall of inside tube 30 at the air outlet side 28. In the exemplary embodiment outlet vanes 51 are four in number and circumferentially equally spaced as shown in FIG. 3. An exemplary outlet vane 51 is also depicted in FIG. 4 as having the same shape and dimensions as inlet vane 50 when inlet vane 50 is a straight vane. Referring to FIGS. 3, 5 and 5A, the key difference between outlet vanes 51 and inlet vanes 50 is that outlet vanes 51 each align along an inside tube centerline 31 with no offset A. Each outlet vane 51 is thus aligned with its own inside tube centerline 31 while remaining normal to the interior wall of inside tube 30.

Figure 7:
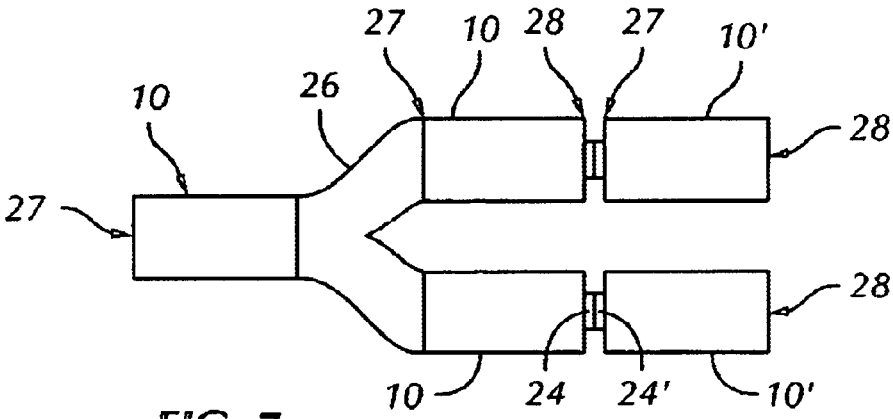
FIG. 7 depicts the use of multiple noise abatement modules.

Referring to FIG. 7, noise abatement module 10 may be used singularly or in conjunction with other noise abatement modules 10 or other systems. For example, noise abatement modules 10 may be aligned in series. Alternatively and additionally, noise abatement modules 10 may include Y-connector 26 to afford parallel alignment as well where the outlet end stub 24 of noise abatement module 10 is joined to the inlet end stub 24 of noise abatement module 10'.

OPERATION

Referring to FIGS. 1, 2, 3, 6, and 6A, noise abatement module 10 is attached to piping or equipment (not shown) from which high pressure air is being exhausted. This is typically accomplished by bolting flange 40 at inlet side 27 to an equipment outlet flange (not shown), thus providing sealed fluid communication between the exhaust air and the interior of noise abatement module 10. High velocity air enters inside tube 30 through the center opening in flange 40 at inlet side 27, and is rotated about its linear axis by inlet vanes 50. This causes outer layer 19 of exhaust 15 to rotate about this linear axis, forcing air into space 33 through inside tube perforations 32, where it is slowed, and high velocity air from core 17 is allowed to expand and move into outer layer 19. Thus exhaust 15 is "chewed" until it has less and less high velocity air.

When the exhaust air nears air outlet side 28, it encounters outlet vanes 51, which stop the rotation of the exhaust air, baffling even more of the exhaust gas outer layer 19, and further "chewing" away outer layer 19. Piping between outlet vanes 51 and the exit flange 40, typically 24"–48" (61.0 cm to 121.9 cm) long and including stub 24 and/or a portion of inside tube 30, acts as a buffer zone to allow the exhaust air to stabilize back to its original linear flow direction.

When used in either or both series and parallel as shown in FIG. 7, each transition through a noise abatement module 10 results in further decrease in the velocity of the air and its attendant noise. The air is finally exhausted to the atmosphere or additional air directing equipment, such as an upward plenum.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A noise abatement module comprising:

an inside tube having an interior, an inlet side, an outlet side and a centerline;

an outside tube;

said outside tube circumferentially about said inside tube;

a space defined by the inside of said outside tube and the outside of said inside tube;

a plurality of inside tube perforations on said inside tube;

said perforations providing fluid communication between said interior of said inside tube and said space;

a plurality of inlet vanes inside said inside tube and proximate said inlet side of said inside tube;

said inlet each having a first vane end and a second vane end;

said second vane end of each inlet vane each being obliquely offset from the centerline of said inside tube; and a plurality of outlet vanes inside said inside tube and proximate said outlet side of said inside tube.

2. The noise abatement module as in claim 1, further comprising:

said inner tube having an inner wall; and said plurality of inlet vanes and said plurality of outlet vanes attached to said inner wall of said inside tube.

3. The noise abatement module as in claim 1, further comprising:

an insulation blanket oriented in said space.

4. The noise abatement module as in claim 1, further comprising:

expanded material supporting said insulation blanket.

5. The noise abatement module as in claim 1, wherein each said plurality of outlet vanes aligned along the centerline of said inside tube.

6. The noise abatement module as in claim 1, wherein said plurality of inlet vanes numbers six.

7. The noise abatement module as in claim 1, wherein said plurality of inlet vanes numbers four.

8. The noise abatement module as in claim 1, wherein:

said outlet side of said inside tube connecting to said inlet side of said inside tube of a subsequent said noise abatement module.

9. The noise abatement module as in claim 1, wherein:

a Y-connector having an inlet end and at least two outlet ends;

said outlet side of said inside tube connecting to said inlet end of said Y-connector; and said each at least two outlet ends on said Y-connector connecting to said inlet side of said inside tube of a subsequent said noise abatement module.

10. The noise abatement module as in claim 1, comprising:

and inside tube having an interior, an inner wall, an inlet side and a centerline;

an outside tube;

said outside tube circumferentially about said inside tube;

a space defined by the side of said outside tube and the outside of said inside tube;

a plurality of inside tube perforations on said inside tube;

said perforations providing fluid communication between said interior of said inside tube and said space;

an insulation blanket oriented in said space;

an expanded material supporting said insulation blanket;

a plurality of inlet vanes attached to said inner wall of inside tube and proximate said inlet side of said inside tube;

said inlet vanes each having a first vane and a second vane end;

said second vane end of each inlet vane each being obliquely offset from the centerline of said inside tube;

a plurality of outlet vanes attached to said inner wall of inside tube and proximate said outlet side of said inside tube; and each of said plurality of outlet vanes aligned along the centerline of said inside tube.

11. The noise abatement module as in claim 10, wherein multiple modules are connecting in series.

12. The noise abatement module as in claim 10, wherein multiple modules are connecting in parallel.

13. A method of abating noise from a high velocity air, said method comprising:

directing said high velocity air through a noise abatement module, said noise abatement module comprising an inside and an outside tube;

rotating said high velocity air about an airflow axis, said rotation effected by a plurality of inlet vanes attached to an interior wall of said inside tube, said inlet vanes having a trailing end oriented obliquely offset from centerline of said inside tube;

directing, through a plurality of inside perforations in said inside tube, said rotated air into a space between said inside tube and sad outside tube;

reducing an air velocity of said high velocity air in said space and an interior of said inside tube; and redirecting said high velocity air exiting said noise abatement module into a liner direction along said airflow axis with a plurality of outlet vanes attached to said inner wall of said inside tube, said outlet vanes being proximate an outlet side of said inside tube and aligned along the centerline of said inside tube.

* * * * *